US006018836A

United States Patent [19]

Williams

[11] Patent Number: 6,018,836

[45] Date of Patent: Feb. 1, 2000

[54] SCRAPER TOOL

[76] Inventor: Robert D. Williams, P.O. Box 3423, Littleton, Colo. 80161-3423

[21] Appl. No.: 09/073,421

[22] Filed: May 6, 1998

Related U.S. Application Data

[60] Provisional application No. 08/044,028, May 6, 1997.

[51] Int. Cl.[7] ..... A47L 13/02

[52] U.S. Cl. ..... 15/111; 15/236.02; 15/236.07; D4/118; D32/46

[58] Field of Search ..... 15/236.01, 236.02, 15/236.05, 236.06, 236.07, 236.08, 236.09, 111; D4/118; D32/40, 46

[56] References Cited

U.S. PATENT DOCUMENTS

| | | |
|---|---|---|
| D. 307,206 | 4/1990 | Boyd . |
| D. 364,720 | 11/1995 | Francis et al. . |
| 2,275,713 | 3/1942 | Ahlborg . |
| 2,846,764 | 8/1958 | Hyneman . |
| 2,981,964 | 5/1961 | Downing . |
| 4,040,140 | 8/1977 | Hopkins et al. . |
| 4,121,316 | 10/1978 | Perry . |
| 4,124,915 | 11/1978 | Schlicher . |
| 4,275,476 | 6/1981 | Hopkins et al. . |
| 4,574,417 | 3/1986 | Magnasco . |
| 4,649,849 | 3/1987 | McCormick . |
| 5,263,222 | 11/1993 | Johnstone . |

*Primary Examiner*—Terrence R. Till
*Assistant Examiner*—Jennifer C. McNeil
*Attorney, Agent, or Firm*—John E. Reilly

[57] ABSTRACT

A scraper tool of one-piece construction is conformable for use in scraping various surfaces and is made up of a generally arched body portion having an intermediate handle section to be gripped by the user and scraper blades at opposite ends of the body portion provided with edges extending in opposite directions transversely across the width dimension at each end so that the application of force in either lengthwise direction to the body portion will cause one of the blades to scrape the materials away from the surface. In an alternate embodiment, the scraper tool may include a handle extension pivotally connected to the body portion and provided with a brush on the handle extension.

10 Claims, 1 Drawing Sheet

SCRAPER TOOL

CROSS-REFERENCE TO RELATED APPLICATIONS

This application is a Provisional of patent application Ser. No. 044,028, filed May 6, 1997 for SCRAPER TOOL, invented by Robert D. Williams.

BACKGROUND AND FIELD OF THE INVENTION

The invention relates to an apparatus for scraping substances from surfaces, and more particularly to a novel and improved apparatus for manually scraping frost and ice from vehicle windshields and windows. The invention is well suited for scraping frost build-up from automobile windshields, but it is immediately appreciated that the invention finds beneficial use in nearly any application where it is desired to scrape a surface to remove a substance therefrom. For example, the apparatus has utility for scraping paint, varnish and the like from surfaces, as well as for removing rust or other deposits.

Scraper devices typifying the present state of the art are disclosed in U.S. Pat. Nos. 4,275,476 to Hopkins et al., 4,121,316 to Perry, 4,124,915 to Schlicher, and 4,040,140 to Hopkins, et al. The devices disclosed in the foregoing patents, and in the scrapers most frequently encountered in commercial use, generally consist of a handle portion upon which is mounted a single scraper blade. The handle portion is gripped in the user's hand, and the user presses the blade into contact with the surface to be scraped. The manual grip commonly used to grasp most known scrapers is illustrated in FIG. 3 of the '140 patent to Hopkins et al., which also reveals a shortcoming of known devices. Because known scrapers contact the work piece surface along the edge of a single blade, the user must press down to realize the scraping action while simultaneously pulling up to prevent the handle from slamming down to the work piece. Consequently, the user's hand functions essentially as a lever, with the thumb or certain fingers pushing upward to serve as a fulcrum while the remaining fingers and/or palm apply a pressure force toward the work piece. In FIGS. 5 and 6 of the '316 patent to Perry, for example, the user's hand is seen to function as a third-class lever, where the thumb is the fulcrum resisting a downward force to stabilize the scraper in use, while the four fingers apply the downward force against the load (the work piece) and the fulcrum. Other scraper grips employ the user's hand as a simple first-class lever. In all cases, known scrapers pit one set of the user's hand muscles against another set, resulting in rapid fatigue and uneven scraping action. Moreover, due to these inherent inefficiencies, the creating of considerable scraping force demands two-handed use of a scraper, where one entire hand serves as a sort of fulcrum and the other hand supplies the scraping pressure. Two-handed use, however, merely compounds the inefficiencies and further reduces overall control of the scraper tool.

Much of the previous effort in the art has been directed toward providing scraper blades whose edges are shaped, or tipped at specified angles with respect to the surface to be scraped, to maximize performance. The foregoing patents, some of which teach specific blade edge configurations, are all hereby incorporated herein by reference.

The present invention addresses an unmet need for a manual scraper apparatus which removes the user's hand from its role as a lever, and thus permits the user to apply a greater scraping force with less fatigue and more control; and further to provide a bi-diectional scraper which is rugged and highly durable and efficient in use.

Summary of the Invention

The invention relates to a manually held and operated scraper for removing, for example, frost, snow, ice and the like from an automobile windshield.

An object of the invention is to provide a novel and improved scraper which is ergonomically improved to reduce unnatural stresses in the user's hand during use.

Another object of the invention is to provide a scraper which permits the user to apply a maximum amount of pressure to the surface to be scraped without sacrificing control.

Still another object of the invention is to provide a more efficient scraper that permits the user to scrape a surface with the return stroke of the scraper, as well as the forward stroke.

An advantage of the invention is that it reduces stress in the user's hand and wrist muscles to reduce fatigue.

Another advantage of the invention is that it permits the user to direct nearly all energy to controlled scraping action, rather than wasting effort in maintaining a stabilizing grip on the device.

In accordance with the invention, therefore, there is provided a preferred embodiment of a scraper tool for scraping a surface, the scraper fashioned generally in the shape of an arch and having an intermediate handle portion and a blade portion at each end of the handle portion, whereby both blade portions are engageable against the surface during scraping. In accordance with an alternative embodiment of the invention, a scraper head fashioned generally in the shape of an arch and having a blade portion at each end thereof is connected to the distal end of an elongated handle.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

The invention relates to scrapers, and more particularly to scrapers for removing ice and snow from vehicle windows and windshields. The scraper apparatus according to the present invention offers a more comfortable and reliable means of manually scraping ice and snow from an automobile windshield. While the invention is most suitable for scraping ice and snow from windows, it is immediately appreciated that the apparatus may have beneficial utility in nearly any instance where it is desired to scrape a surface to remove a substance therefrom, such as scraping old paint or deposits from a wall or the like.

Referring to FIGS. 1–4, the apparatus of the invention broadly comprises an elongated unitary scraper 10 having a body of an arched shape defining a handle portion 15 intermediately between two scraper blades 18 and 20. The scraper 10 preferably is fashioned from a durable plastic soft enough not to scratch glass but rigid and substantially inflexible in use. The scraper 10 may be injection molded, but preferably is thermoplastically formed from a strip or piece of acrylic or polycarbonate.

Figure 3:
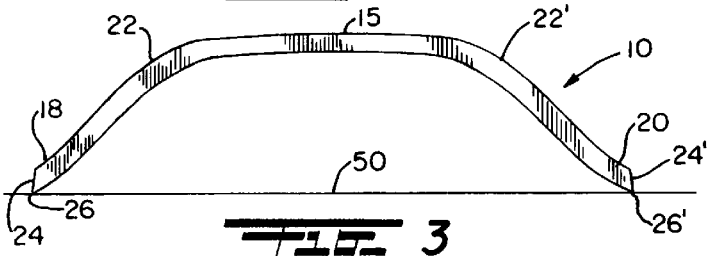
FIG. 3 is a side view in elevation of the embodiment of the invention shown in FIG. 1.

As best seen in FIG. 3, the scraper 10 is fashioned in the shape of a somewhat flattened arch so that the handle portion 15 is substantially flat so as to be within an imaginary plane substantially offset above the plane containing the edges of the scraper blades 18, 20. The handle portion 15 may be substantially planar, or may feature a mild convex curvature outward or spaced from a surface 50 upon which it is used. Accordingly, a user of the invention may grasp the handle portion 15 in his or her hand and place the scraper blades 18 and 20 in contact with the surface 50 to be scraped, without one's knuckles contacting or rubbing against the surface.

Figure 1:
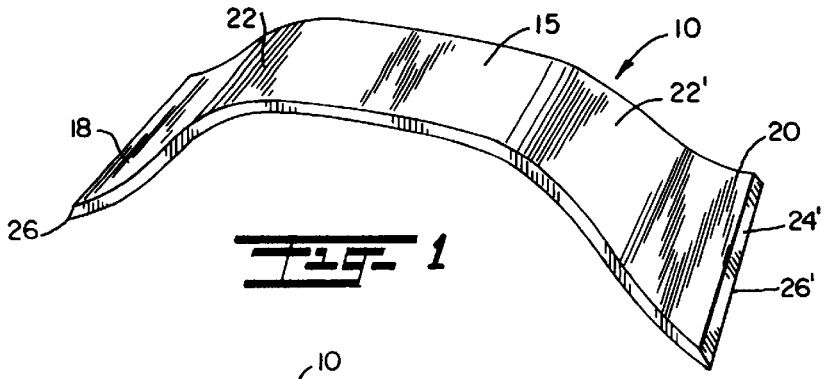
FIG. 1 is a perspective view from above a preferred embodiment of the invention.
Figure 2:
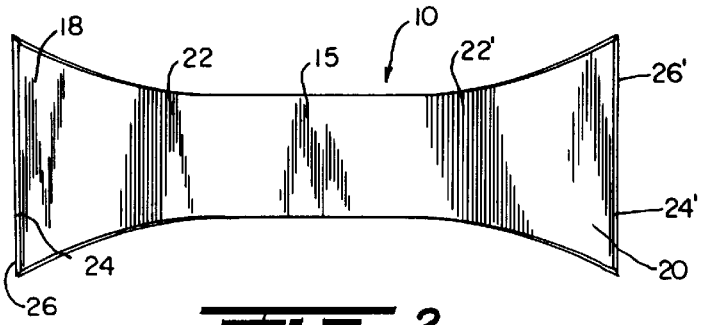
FIG. 2 is a top plan view of the embodiment of the invention shown in FIG. 1.
Figure 4:
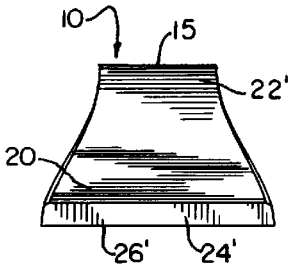
FIG. 4 is an end view in elevation of the embodiment of the invention shown in FIG. 1.

FIGS. 2 and 4 show that the width of the handle portion 15 is somewhat less than the width of the scraper blades 18, 20, to provide a handle portion 15 that is easy to grip, yet without sacrificing functional blade width. FIG. 2 illustrates that taper portions 22, 22' curve with respect to the longitudinal axis of the scraper 10 to provide a gentle transition which converges from the width of each of the blades 18, 20 to the narrower handle 15. Additionally, as seen in FIG. 3, the taper portions 22, 22' present a mild S-curve shape in the vertical plane to provide the structural connection between the blades 18, 20 and the handle portion 15, the taper portions 22, 22' undergoing an angle of approach on the order of 45° to the surface to be scraped, then flattening somewhat into a slightly lesser angle to the surface to be scraped. The apparatus preferably has an overall length from about eight inches to about twelve inches, with the handle portion 15 being from about three inches to about five inches long to be comfortably grasped in one hand.

The scraper blades 18, 20 are beveled along their widths to fashion a chamfer 24, 24' on the upper surface, so that the edge of each blade 18, 20 defines a generally downwardly directed sharp edge 26, 26, as best illustrated by FIG. 3. Each edge 26, 26' addresses at an angle the surface 50 to be scraped, the chamfered surfaces 24, 24' each forming an angle of slightly less than 90° with the surface to be scraped. The chamfers 24, 24' and edges 26, 26' face in opposite directions outwardly from the handle portion 15, so that the maximum scraping effect of one blade 28 is realized when the scraper 10 is moved one direction (e.g. to the left in FIG. 3), and the other blade 20 is effective when the scraper 10 is drawn in the opposite direction (e.g. to the right in FIG. 3).

The advantages of the apparatus of the invention are manifested in a more ergonomic and comfortable use, increased pressure as well as the bi-directional scraping capability. To practice the invention, the user places the scraper 10 against the surface 50, such as, an automobile windshield to be scraped. The scraper 10 is positioned against the surface 50 so that both edges 26, 26' of both blades 18, 20 are in contact with the surface, while the handle 15 is spaced apart from the surface. Downward forces upon the handle 15 of the scraper 10 (as positioned in FIG. 3) are transmitted to the surface 50 via both tapered portions 22, 22, rather than through a single unbalanced handle element as typified by currently known scrapers. Accordingly, the effort of the user is simplified into the two simple acts of pushing downward, and reversibly advancing the scraper 10 back and forth upon the surface 50. Since the handle portion 15 is supported at both ends by the engagement of the blades 18, 20 against the surface 50, the handle portion 15 serves to transmit only downward and side-to-side forces during use. The user's manual force downward is resolved into two more or less balanced and roughly parallel force vectors which are resisted by the surface 50 to be scraped, freeing the user from the need to supply with his hand any tiring counteractive "fulcrum" force to the handle 15. As a result, more of the user's energy is devoted to the actual business of scraping than is the case with known devices, and less effort is required to stabilize the scraper 10 and maintain the blades 18, 20 in proper scraping position in relation to the surface 50. Released from the need to devote energy and attention to holding the scraper 10 and manipulating its position, the user is able to apply a greater downward pressure on the handle portion 15 resulting in improved scraper performance, particularly on deeply layered frost or thick paint build-ups. The scraper 10 of the present invention, thus being more ergonomic and less fatiguing, promotes a more controlled scraping action, which is especially desirable when the surface to be scraped is subject to damage, for example, when scraping aged wallpaper from a wall.

Another advantage of the invention is that the scraper 10 is bi-directionally functional, permitting the user to perform a scraping action with both a forward and a return stroke of the hand. Thus, as the scraper 10 is pushed on a forward stroke across a surface, for example, the surface 50 of FIG. 3 from right to left, the edge 26 of a first blade 18 effectively functions to lift material from the surface and scrape it away. As the user pulls the scraper back on a return stroke, for example, from left to right in FIG. 3, the edge 26' of a second blade 20 primarily serves to scrape the surface 50. A similar efficiency in scraping energy is realized using a manual side-to-side action, as opposed to forward-and-back, depending upon user preference and the configuration of the surface to be scraped. Notably, the overall arched or arcuate shape of the scraper 10 fully accommodates the comparatively large-radius of curvature of most automobile windshields, as the curvature of the surface occurs between the points where the edges 26, 26' contact the surface 50 but beneath and out of contact with the handle portion 15.

Figure 5:
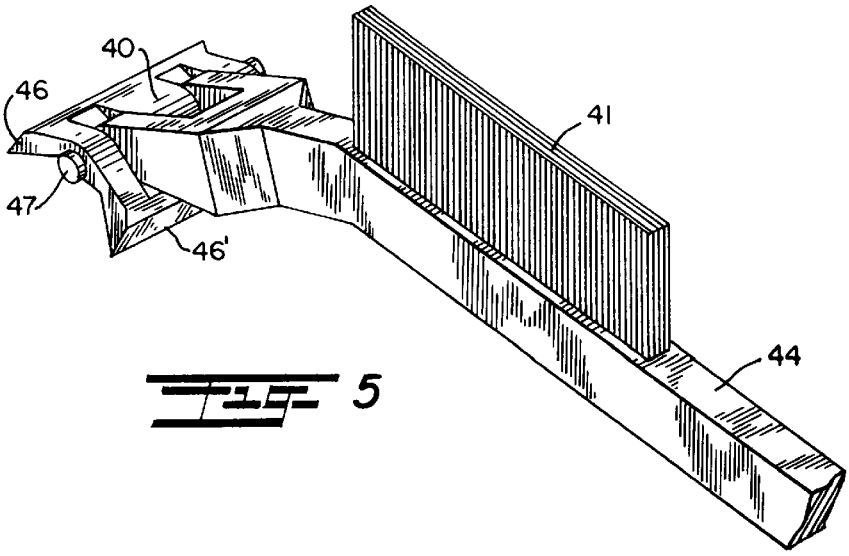
FIG. 5 is a perspective view of an alternative embodiment of the invention.

This efficient, bi-directional utility of the invention may be exploited by an alternative embodiment of the invention depicted in FIG. 5. In the alternative embodiment, a scraper head 40 is pivotally attached to an elongated extension handle 44. The handle 44 optionally is provided with brush 41 for sweeping away debris, as already generally appreciated in the art. In the inventive alternative embodiment, scraper head 40 is shaped overall substantially similarly to scraper 10 of FIGS. 1–4, except that head 40 is comparatively smaller in size, for example from one-fourth to about one-third the size of scraper 10. In this alternative embodiment, the downward pressing force is supplied by the user to the scraper head 40 via the handle 44. The downward pressure is imparted to the surface via the two blades 46, 46' which function substantially similarly to the blades 18, 20 of scraper 10.

To promote a balanced application of force from the handle 44 through the two blades 46, 46', the scraper head 40 is pivotally mounted to the distal end of the handle 44 by means of a pivot pin 47 transversely of the length of the body. In the illustrated alternative embodiment, to increase strength and durability the distal end of the handle 44 is forked, with the pivot pin 47 passing through both tines of the fork as well as the body of the scraper head 40. Accordingly, the scraper head 40 pivots around the pin 47 and with respect to the handle 44 in response to the movement of the handle 44 while the blades 46, 46' remain in contact with a surface to be scraped. The pivoting arcuate movement of the scraper head 40 allows this alternative embodiment of the invention to adapt rapidly to changing shapes or curvatures in the surface to be scraped without the need for rapid and dramatic movements in the handle 44, thus increasing the versatility of the invention. Additionally, the flexible relation between the handle 44 and the scraper head 40 attributable to the pivotal connection therebetween reduces the stress and fatigue otherwise resulting from the users's grip upon the handle 44 as encountered in known scraper devices.

Accordingly, the user may take the handle 44 in his hand, place both blades 46, 46' against the surface to be scraped, and draw the apparatus to and fro across the surface to be scraped. With minimal movement or stress in the user's hand and wrist, the opposing blades 46, 46' alternatively scrape the surface with each alternating stroke of the apparatus, as previously explained.

It is therefore to be understood that while preferred and alternate forms of invention have been herein set forth and described, various modification and changes may be made in the construction and arrangement of parts, composition of materials, and order of steps without departing from the spirit and scope of the present invention as defined by the appended claims and reasonable equivalents thereof.

I claim:

1. In a scraper tool adapted for scraping materials from a surface comprising:

an elongated generally arched body portion of uniform thickness including a handle adapted to be gripped in at least one hand of a user and a pair of scraper blades, said scraper blades diverging away from said handle to define opposite ends of said body portion, said blades having corresponding scraper edge portions extending in opposite directions to one another transversely across the width of each of said ends, each of said scraper edge portions having a beveled scraper surface terminating in a sharp scraping edge; and wherein application of force in either lengthwise direction to said body portion will cause one of said blades to scrape materials away from said surface.

2. A scraper tool according to claim 1 wherein each of said opposite ends have beveled edges at less than 90° to said surface to be scraped.

3. A scraper tool of one-piece construction adapted for removal of ice and snow from a windshield or other window surface comprising:

an elongated, convex one-piece body portion of uniform thickness and generally rectangular cross-sectional configuration tapered in width from relatively wide end portions into a narrower intermediate section, said intermediate section defining a handle portion; and wherein said end portions terminate in downwardly directed, sharp, flat beveled scraping surfaces of corresponding size and construction transversely across the width thereof and facing in opposite directions to one another.

4. A scraper tool according to claim 3 wherein said scraping surfaces each form an angle of less than 90° to a surface to be scraped.

5. A scraper tool according to claim 3, wherein said end portions establish an angle of approach of approximately 45° to the surface to be scraped and terminate in outwardly bowed scraping edges of a reduced angle.

6. A scraper tool according to claim 5 wherein said end portions verge into said scraper edges at angles of less than 45° to the surface to be scraped.

7. A scraper tool according to claim 3 wherein a handle extension is pivotally connected to said intermediate section.

8. A scraper tool according to claim 7 wherein said handle extension is in the form of an elongated rod.

9. A scraper tool according to claim 7 wherein said handle extension is pivotal about an axis extending transversely of said body portion.

10. A scraper tool according to claim 9 wherein a brush member is provided on said handle extension.

* * * * *